US007940176B2

(12) United States Patent
Bohen et al.

(10) Patent No.: US 7,940,176 B2
(45) Date of Patent: May 10, 2011

(54) LOCK INTERACTION WITH SOFTWARE TO FACILITATE ACCESS TO CASH HANDLING DEVICE FUNCTIONALITY

(75) Inventors: Daniel Christopher Bohen, Charlotte, NC (US); Amy Baker Folk, Charlotte, NC (US); William Thomas Sanders, Denver, NC (US); Shane Anthony Johnson, Charlotte, CA (US); Paul Martin Mattison, Sherrills Ford, NC (US)

(73) Assignee: Bank of America Corporation, Charlotte, NC (US)

( * ) Notice: Subject to any disclaimer, the term of this patent is extended or adjusted under 35 U.S.C. 154(b) by 279 days.

(21) Appl. No.: 12/212,442

(22) Filed: Sep. 17, 2008

(65) Prior Publication Data

US 2010/0066491 A1 Mar. 18, 2010

(51) Int. Cl.
*E05B 45/06* (2006.01)

(52) U.S. Cl. ..... 340/542; 340/5.2; 340/5.41; 340/5.73; 235/379; 70/278.1; 109/44

(58) Field of Classification Search ..... 340/542, 340/5.8, 5.85, 5.9, 5.2, 5.21, 5.22, 5.23, 5.24, 340/5.25, 5.26, 5.28, 5.3, 5.31, 5.41, 5.73; 235/79; 70/91, 126, 278.1; 109/2, 21, 39, 109/44, 58

See application file for complete search history.

(56) References Cited

U.S. PATENT DOCUMENTS

| | | | | |
|---|---|---|---|---|
| 3,881,171 | A * | 4/1975 | Moorman et al. | 340/5.28 |
| 5,451,757 | A | 9/1995 | Heath, Jr. | |
| 5,488,358 | A * | 1/1996 | Hamilton et al. | 340/5.26 |
| 5,488,660 | A * | 1/1996 | Dawson et al. | 713/182 |
| 5,541,581 | A | 7/1996 | Trent | |
| 5,873,276 | A | 2/1999 | Dawson et al. | |
| 5,944,163 | A | 8/1999 | Keith, III et al. | |
| 6,130,621 | A * | 10/2000 | Weiss | 340/5.28 |
| 6,523,742 | B1 | 2/2003 | Awatsu et al. | |
| 2008/0149706 | A1 | 6/2008 | Brown et al. | |

FOREIGN PATENT DOCUMENTS

| | | |
|---|---|---|
| EP | 0 793 196 A2 | 9/1997 |
| EP | 1 703 473 A2 | 9/2006 |

OTHER PUBLICATIONS

International Search Report for related Application No. PCT/US2009/057300, mailed Dec. 4, 2009, pp. 1-4.

* cited by examiner

*Primary Examiner* — Toan N Pham
(74) *Attorney, Agent, or Firm* — Banner & Witcoff, Ltd.; Michael Springs

(57) ABSTRACT

Methods and devices provide for lock interaction with software in order to facilitate access to a vault in a cash handling device and display of a transportation utility interface. A user may access an electromechanical lock on a cash handling device. The lock may determine whether the user is authorized. If unlocked, access may be provided to a transportation utility interface and to a vault that may contain currency in order to facilitate removal and transportation of the currency. If desired, stackers in the cash handling device may automatically transfer the currency to a container in the vault after the lock is unlocked. The vault may be subsequently closed, access to the transportation utility interface may be disabled, and the lock may be re-locked.

20 Claims, 7 Drawing Sheets

LOCK INTERACTION WITH SOFTWARE TO FACILITATE ACCESS TO CASH HANDLING DEVICE FUNCTIONALITY

BACKGROUND

Traditionally, transportation carriers are required to login to a transportation utility screen as well as unlock an electromechanical lock in order to access a vault in a cash handling device (e.g. a cash recycler) in order to withdraw money there from for transport. For example, transportation personnel may use the transportation utility screen to transfer currency from the stackers in the cash handling device into a transport cartridge. The electromechanical lock may then be unlocked in order to access the vault and withdraw the transport cartridge containing the money.

Currently, there is no way to access the transportation utility interface and access the vault by only unlocking the electromechanical lock. In addition, there is no current way to automatically trigger transport processes (e.g. transferring of funds to a transport cartridge).

Consequently, current transportation processes require manual triggers, multiple steps in a transport process, and transport carriers to keep track of multiple logins and passwords. In addition, carriers may also have access codes.

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

In accordance with various embodiments of the present invention, methods and devices can provide a lock interaction with software in order to facilitate allowing access to a vault in a cash handling device and display of a transportation utility interface for the cash handling device.

In one embodiment, user input may be provided to an electromechanical lock. The electromechanical lock may determine whether the input is correct or authorized. The electromechanical lock may be unlocked if the input is authorized. Access may be provided to a transportation utility screen in response to the unlocking of the electromechanical lock. Access may be provided to a vault in response to the unlocking of the electromechanical lock.

In another embodiment, currency may be allowed to be removed from the vault. The currency may be in a container (e.g., a cartridge, bag, box, case, etc.).

In still another embodiment, the vault may be closed either manually or automatically after the currency is removed from the vault.

In yet another embodiment, access to the transportation utility screen may be disabled after the currency is removed from the vault.

In a further embodiment, the electromechanical lock may be locked after the currency is removed from the vault and the vault is closed.

In another embodiment, input to the electromechanical lock may be prevented after a pre-determined number of failed attempts to obtain authorization.

In yet a further embodiment, currency may be transferred to the vault or a container in the vault automatically after the electromechanical lock is unlocked.

In addition, the foregoing embodiments can be implemented in an apparatus that includes a processor for executing computer executable instructions, memory that stores the computer executable instructions, an input means for receiving user input, a display for displaying notifications and messages to the user, a printer for printing receipts, and a communication interface in order to communicate with remote locations. Each of the above-identified method steps can be implemented as computer-executable instructions that are stored in the memory and executed by the processor.

In still another embodiment, the cash handling device may be a cash recycler.

In another embodiment, an input means and display may include a touch sensitive screen.

In yet another embodiment, the input means may include a touch-sensitive screen.

In still another embodiment, the display may include a touch sensitive screen.

In other embodiments, the input means may include a keypad or keyboard.

Additional features and advantages of the invention will be apparent upon reviewing the following detailed description.

BRIEF DESCRIPTION OF THE DRAWINGS

The present disclosure is illustrated by way of example and not limited in the accompanying figures in which like reference numerals indicate similar elements.

DETAILED DESCRIPTION

In accordance with various aspects of the disclosure, systems and methods are illustrated for providing lock interaction with software in order to facilitate entering of a vault in a cash handling device and access to a transportation utility interface in the cash handling device.

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
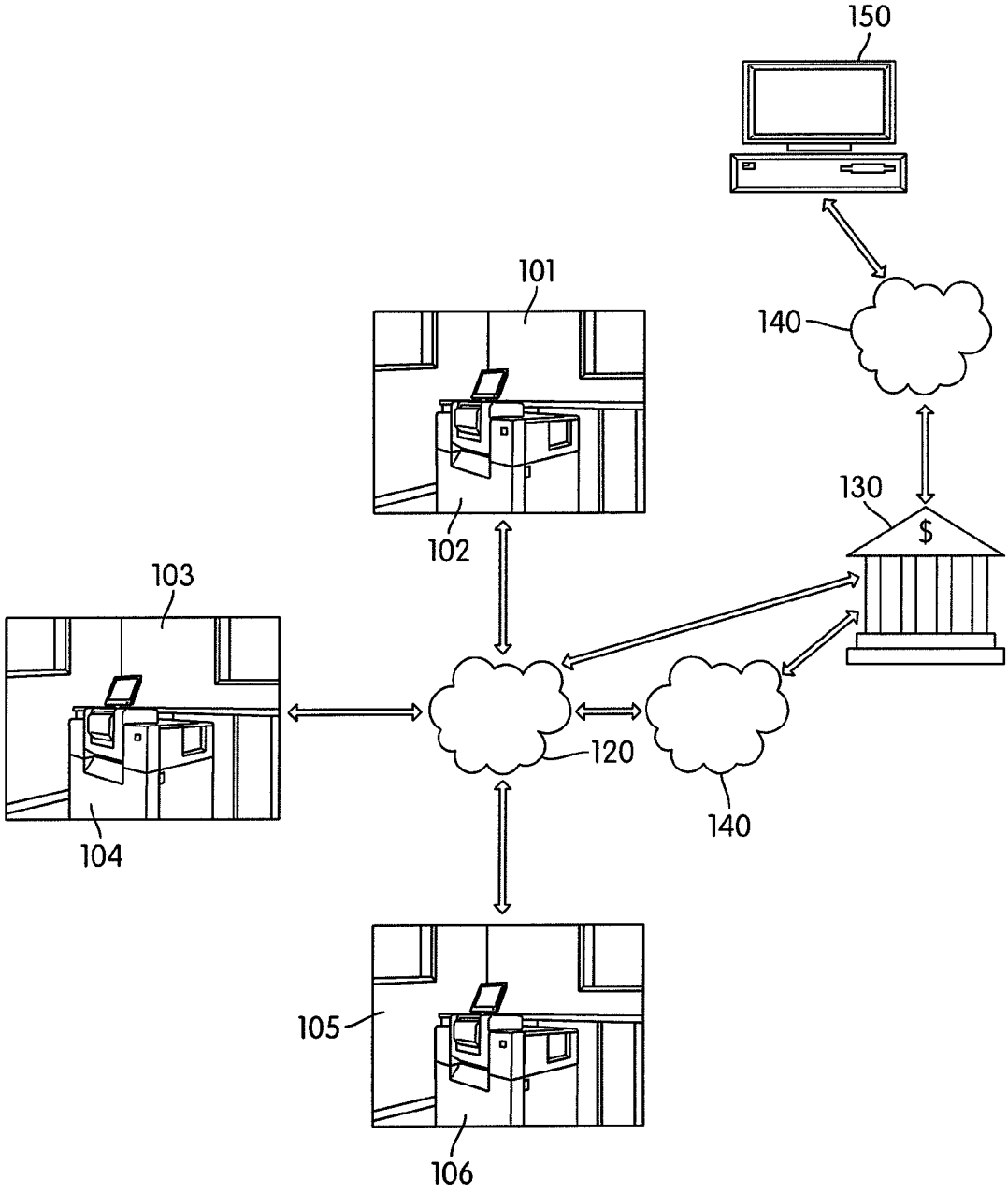
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 such as the STAR network before being connected to bank 130. According to one or more arrangements, bank 130 may utilize an infrastructure which includes a server 150 having components such as a memory, a processor, a display, and a communication interface.

Figure 2:
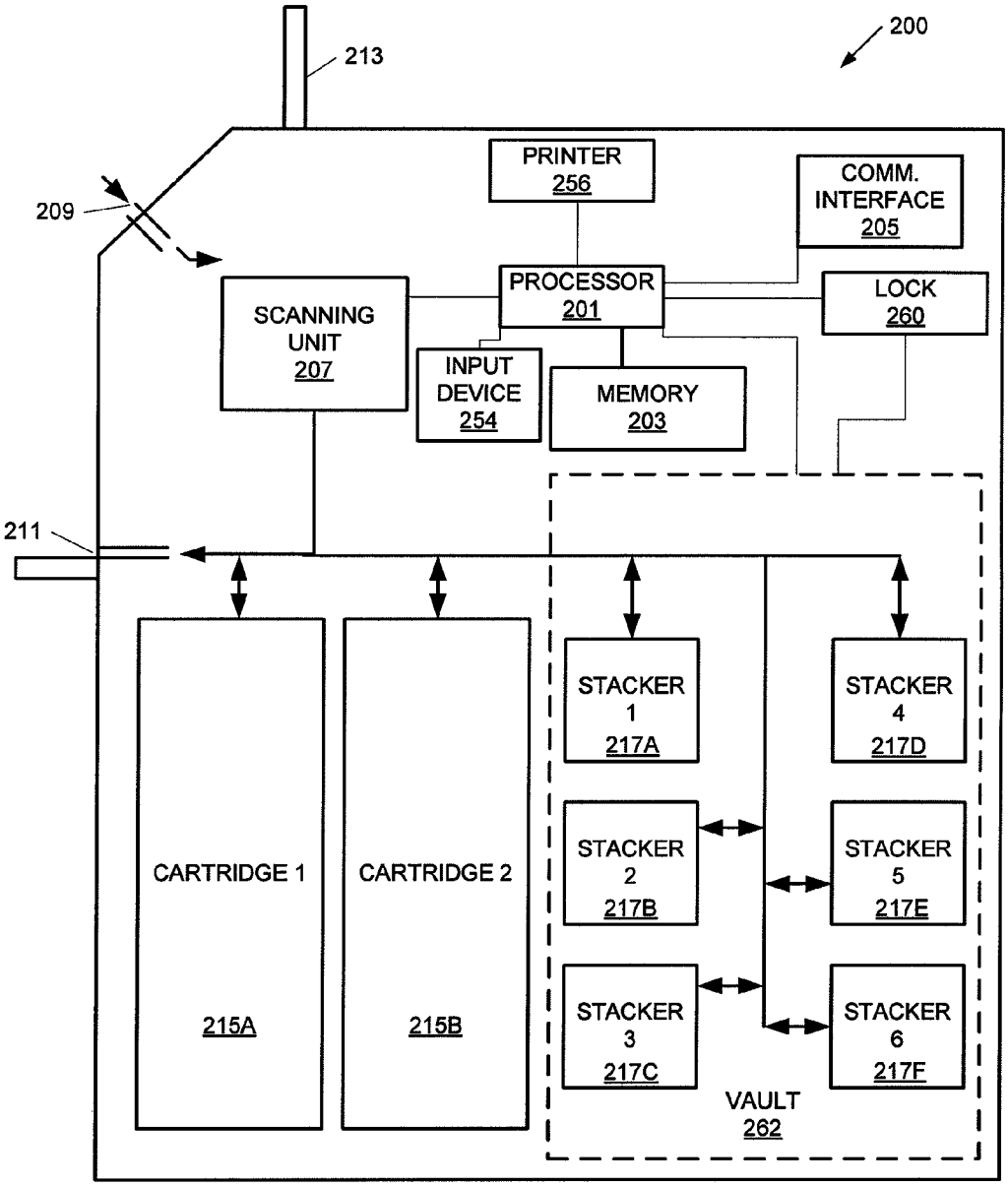
FIG. 2 illustrates a simplified diagram of a currency recycler in accordance with an aspect of the invention.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and stackers 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

Input device(s) 252 may provide functionality for reading indicia stored on containers (e.g., bags, boxes, cases, etc.). The reader(s) 252 may be scanners, barcode scanners, RFID readers, magnetic strip readers, proximity card readers, or any other type of reader capable of reading or scanning indicia.

In cash recycler 200, stackers 217 and cartridges 215 are configured to store currency. Currency may be inserted through input slot 209 and withdrawn through withdrawal slot 211. Stackers 217 may be used to store and organize currency based on denomination. For example, all $5 bills may be stored in stacker 2 (i.e., stacker 217B) while all $20 bills may be stored in stacker 3 (i.e., stacker 217C). Cartridges 215A and 215B, on the other hand, may be used to store overflow currency and/or currency for transport. Thus, if stackers 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and stackers 217 may further be removable for easier access or transport.

Scanning unit 207 may be configured to scan each bill or currency that is inserted into recycler 200. Scanning unit 207 may be configured to detect defects, counterfeits, denomination, type of currency (e.g., which country the currency originates from) and the like. Scanning unit 207 may further be configured to refuse money (either through input slot 209 or withdrawal slot 211) if it cannot be properly recognized or if the currency is deemed to be counterfeit. Scanning unit 207 may send such data to processor 201 which may, in turn, save the data in memory 203.

Further, recycler 200 may include one or more mechanical or electromechanical systems (not shown) for automatically transferring currency between stackers 217, cartridges 215, input slot 209 and withdrawal slot 211 in recycler 200. For example, currency may automatically be withdrawn from stackers 217 and directed into cartridge 215A for storage using a series of motorized rollers. In another example, currency stored in cartridge 215A may be withdrawn and organized and stored into stackers 217 according to denomination. Using such systems to facilitate the automated movement of currency between storage components and other portions of recycler 200 may provide efficiency and security by alleviating some of the need to manually handle currency stored within recycler 200.

Recycler 200 may also include a lock 260, such as any of the electromechanical locks depicted in FIGS. 5A-5G. The lock 260 may be in electrical communication with processor 201 and may also be in communication with vault 262. The vault 262 may also included one or more removable containers or cartridges (not shown) in order to receive currency from stackers 217A-217F in order to facilitate transportation of currency and removal of the currency from the recycler 200 by transportation personnel. The vault 262 may be a separate physical structure in recycler 200. Alternatively, the vault 262 may simply refer to a a logical structure that provides secure access to one or more of stackers 217A-217F (or compartments containing the stackers). This is analogous to the distinction between a physical hard drive and a logical hard drive, which may simply be a partition on a physical hard drive.

One or more input devices may also be included as part of the electromechanical lock 260. Electromechanical locks having input devices are depicted in FIGS. 5A-5G. Such input mechanisms may include a mechanical dial, keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of conveying information to the lock 260.

Figure 3:
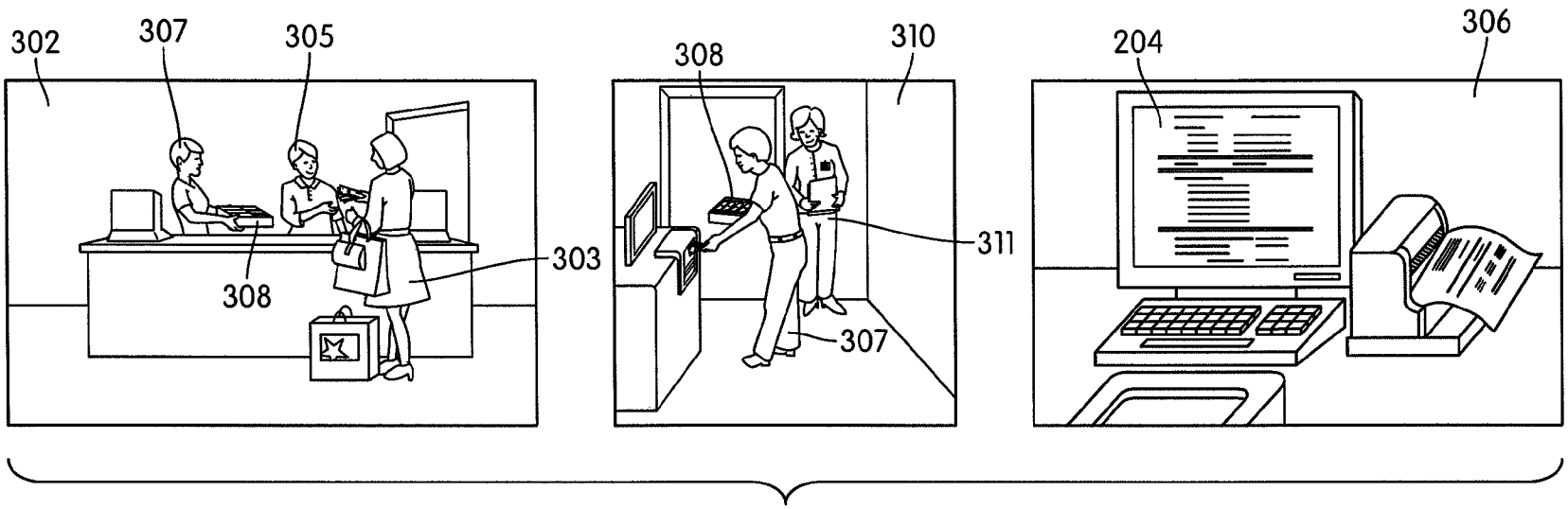
FIG. 3 illustrates various features of a currency recycler that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
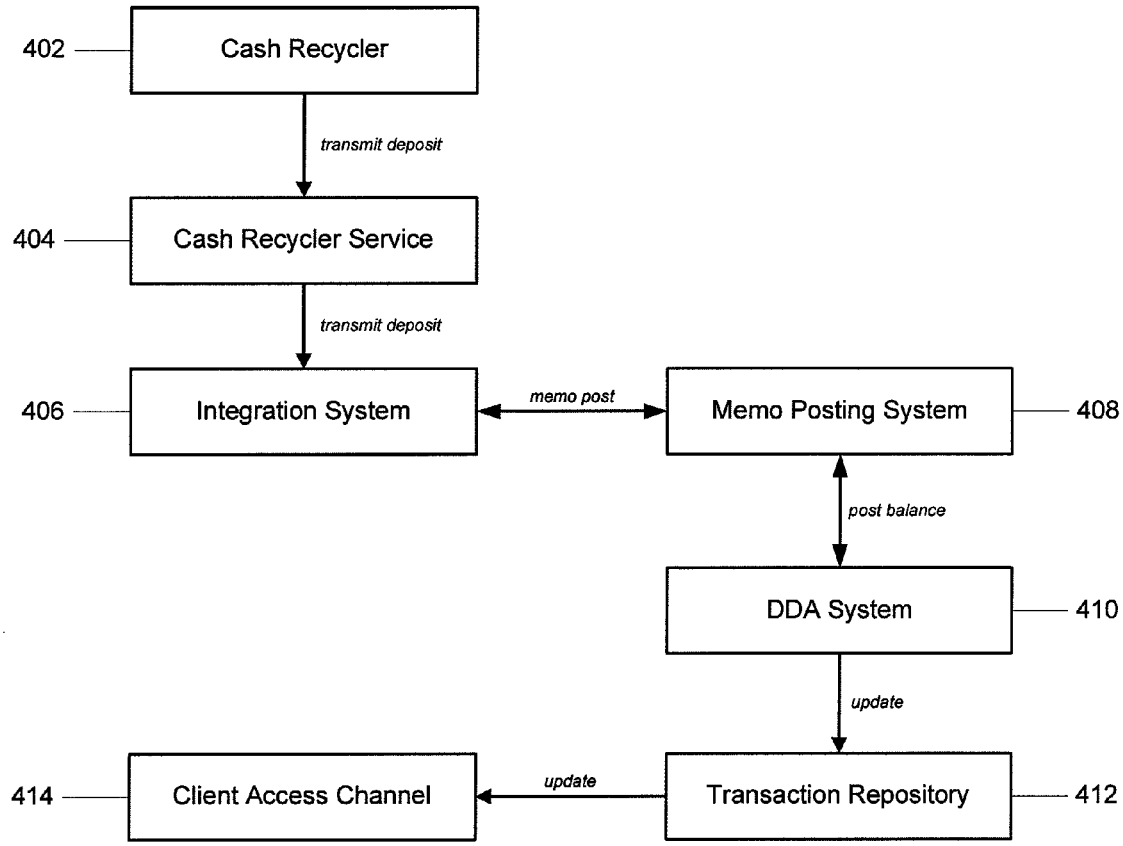
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

FIGS. 5A-5G illustrate sample electromechanical locks that may be used in accordance with various aspects of the present invention. Other locks, of course, may also be used. The locks shown in FIGS. 5A-5G are commercially available from Kaba Mas LLC and can be seen, for example, at http://www.mas-hamilton.com/a.php?page=kaba_brand.

Figure 5A:
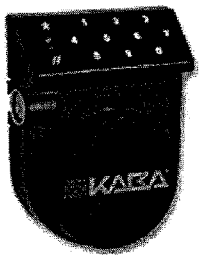
FIGS. 5A-5G illustrate example locks that may be used in accordance with various aspects of the present invention.
Figure 5B:
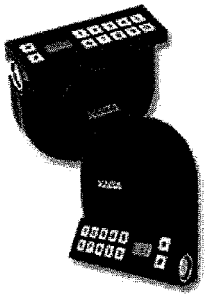
Figure 5C:
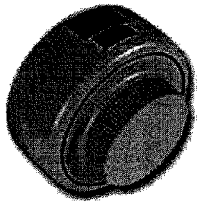
Figure 5D:
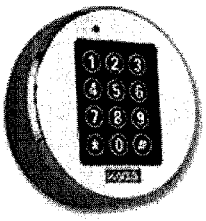
Figure 5E:
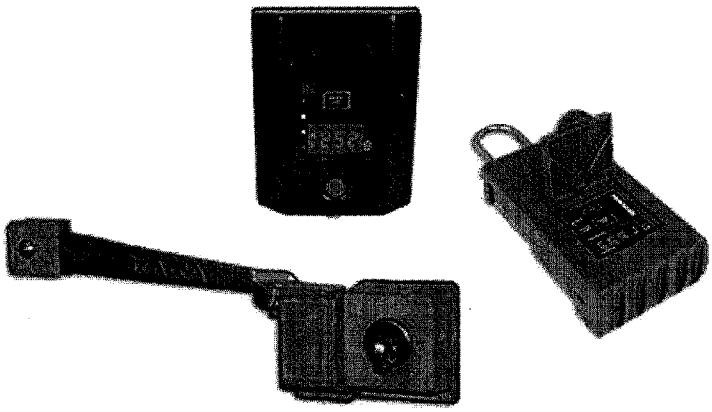
Figure 5F:
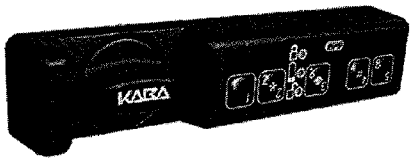
Figure 5G:
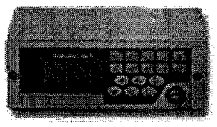

FIG. 5A is an example from the Auditcon family of locks. FIG. 5B shows the Cencom System 2000. FIG. 5C is an example from the X-09 High Security Lock family. FIG. 5D is an example from the LC Series of locks. FIG. 5E shows examples from the Gitcon locks, which stands for access control for goods-in-transit. FIG. 5F shows an example Unicon lock. FIG. 5G depicts an example from the Vindicator lock family.

Figure 6:
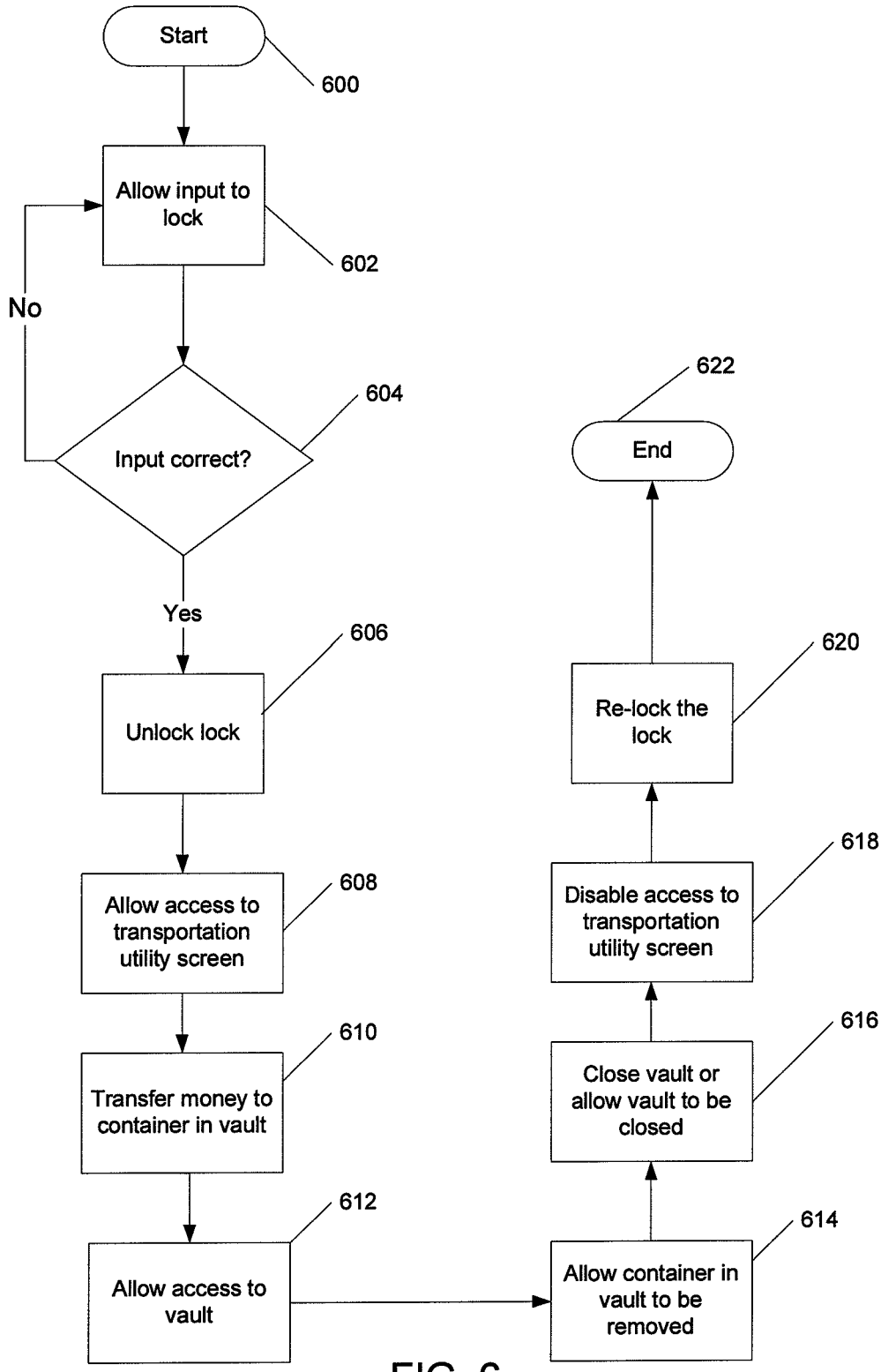
FIG. 6 illustrates an example method for providing lock interaction with software in order to facilitate access to a vault in a cash handling device and access to a transportation utility interface in the cash handling device.

FIG. 6 illustrates an example method for providing lock interaction with software in order to facilitate access to a vault in a cash handling device (e.g., cash recycler 200 of FIG. 2) and access to a transportation utility interface in the cash handling device. Upon start of the process 600, a user may access the electromechanical lock 260 and attempt to open it 602 by, for example, entering the user's pin, password, combination, code, etc. If the input provided by the user is correct 604, the electromechanical lock may be unlocked 606. If the input provided by the user is incorrect 604, the user may again be allowed to provide an input 602 to the lock 260 in an attempt to open in. In certain embodiments, the number of failed attempts by the user to obtain authorization and thus open the lock may be limited (not shown).

Figure 7:
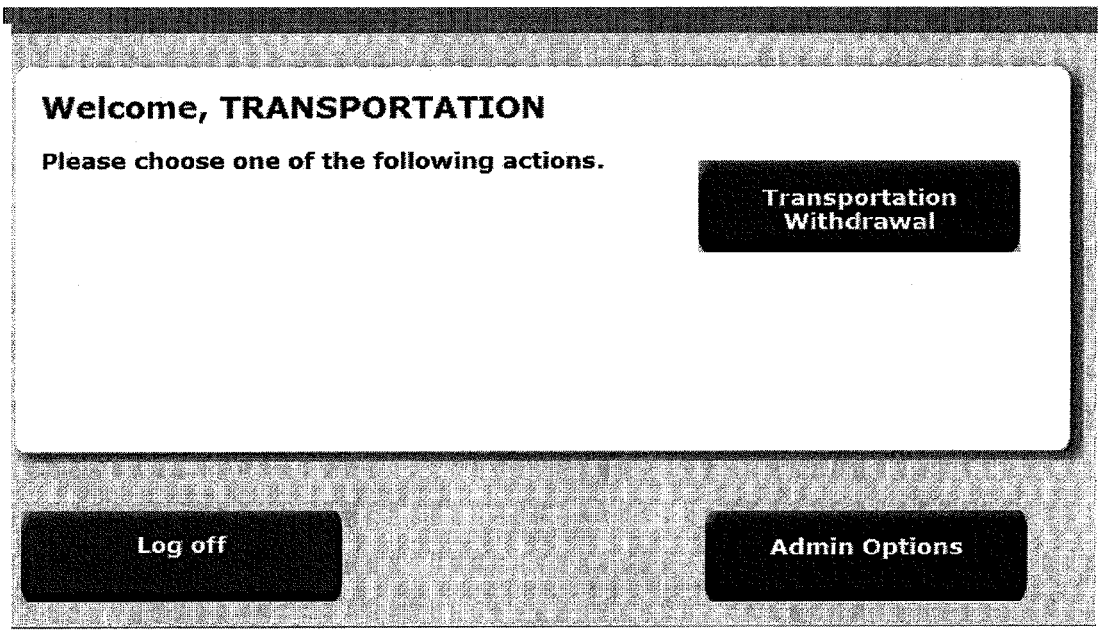
FIG. 7 depicts a sample transportation utility screen.

After the lock is unlocked 606, access may automatically be provided to a transportation utility screen 608 on the display 213. The transportation utility screen may be any message shown on the display 213 or any graphical user interface shown the display that in any way facilitates transportation of currency or withdrawal of currency from the recycler 200. An example transportation utility screen is shown in FIG. 7. In one example, a sensor may be included in a cash handling device to detect when the electromechanical lock has been appropriately unlocked. In another example, the electromechanical lock may be connected to a processor or other controller in the cash handling device such that a signal is sent to the controller when the electromechanical lock has been successfully unlocked. Thus, a transport carrier might only need to carry one password or code for the recycler machine to access and perform the functions necessary for preparing the funds for transport.

After the lock 260 is unlocked 606, currency in the recycler 200 may be automatically transferred 610 to the vault 262 or to a container in the vault 262. The currency may be transferred from any of stackers 217A-217F. In particular, in one or more arrangements, the unlocking of lock 260 may trigger the automatic transfer of funds to be transported to a specified container 610. This reduces some of the time required to extracts funds from a cash handling device such as recycler 200 during the transport process.

In embodiments in which a cash handling device does not have a section for storage for funds to be removed, there may be no need for currency to be transferred 610. Accordingly, access to the location of the currency may allowed 612 without performance of a transfer step.

After the lock 260 is unlocked 606, the user may be provided access to the vault 262 and allowed to remove the contents of the vault 614. The vault may then be manually or automatically closed 616 and access to the transportation utility screen may be disabled 618. The electromechanical lock may also be re-locked 620, after which the process may be completed 622.

While FIG. 6 is described with respect to cash recycler 200 of FIG. 2, it is to be understood that the same or similar features may be used with any cash handling device. Additionally, unlocking of an electromechanical lock such as a KABA MAS lock might trigger other functions as well. For example, the unlocking of a lock may trigger auto-rebalancing of a cash handling device, unlocking of one or more other compartments (e.g., stackers 217A-217F) and the like. Still further, the function that is triggered in response to unlocking of a lock may depend on the code or password that is entered. Thus, a transport carrier might enter one password to trigger transport processes and a different password to trigger unlocking of one or more other components. A master code might be used to trigger all or a subset of features that can be triggered by the unlocking of the electromechanical lock.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

We claim:

1. A method comprising:

receiving, by a cash handling device, an input to an electromechanical lock, wherein the cash handling device comprises the electromechanical device;

determining, by the electromechanical lock, whether the input is authorized;

unlocking the electromechanical lock if the input is authorized;

providing access to a transportation utility screen only in response to the unlocking of the electromechanical lock, wherein the transportation utility screen displays information about transportation of currency from the cash handling device; and providing access to a vault in response to the unlocking of the electromechanical lock.

2. The method of claim 1 further comprising enabling the currency to be removed from the vault.

3. The method of claim 2 further comprising enabling the vault to be closed.

4. The method of claim 3 further comprising disabling access to the transportation utility screen.

5. The method of claim 4 further comprising locking the electromechanical lock.

6. The method of claim 5 further comprising preventing further said input to the electromechanical lock after a predetermined number of failed attempts to obtain authorization.

7. The method of claim 1 further comprising automatically transferring the currency to a container in the vault prior to said providing said access to the vault in response to the unlocking of the electromechanical lock.

8. The method of claim 7 further comprising enabling the container containing the currency to be removed from the vault.

9. The method of claim 8 further comprising enabling the vault to be closed.

10. The method of claim 9 further comprising disabling access to the transportation utility screen.

11. The method of claim 10 further comprising locking the electromechanical lock.

12. The method of claim 11 further comprising preventing further said input to the electromechanical lock after a predetermined number of failed attempts to obtain authorization.

13. The method of claim 5 wherein one or more of the steps of the method are implemented as computer-executable instructions stored on at least one computer-readable medium.

14. The method of claim 11 wherein one or more of the steps of the method are implemented as computer-executable instructions stored on at least one computer-readable medium.

15. A method comprising:

receiving, by a cash handling machine, an input to an electromechanical lock in the cash handling machine;

determining, by the electromechanical lock, whether the input is authorized;

unlocking the electromechanical lock if the input is authorized;

displaying information about transporting currency from the cash handling machine on a transportation utility screen only in response to the unlocking of the electromechanical lock;

transferring said currency to a container in a vault in response to the unlocking of the electromechanical lock;

providing access to the vault in response to the unlocking of the electromechanical lock;

enabling the container in the vault to be removed;

enabling the vault to be closed;

disabling access to the transportation utility screen; and locking the electromechanical lock.

16. The method of claim 15 wherein the transfer of said currency to the container is performed automatically when the electromechanical lock is unlocked.

17. The method of claim 16 wherein the vault is closed automatically after the container is removed from the vault.

18. The method of claim 15 wherein one or more of the steps of the method are implemented as computer-executable instructions stored on at least one computer-readable medium.

19. An apparatus comprising:

a processor for executing computer-executable instructions;

a memory that stores the computer-executable instructions;

a display configured to display a transportation utility screen in accordance with signals received from the processor executing the computer-executable instructions;

an electromechanical lock in communication with the processor and a vault, said vault storing a container;

at least one stacker holding said currency;

an input means for receiving user input;

wherein the computer-executable instructions, when executed by the processor, cause the apparatus to:

receive user input;

determine, based on said user input, whether said user is authorized to remove said currency from the apparatus;

unlock the electromechanical lock;

provide access to the transportation utility screen only in response to unlocking the electromechanical lock;

display, on the transportation utility screen, information about transporting said currency from the apparatus;

transfer said currency from said at least one stacker to the container in the vault;

enable access to the vault;

enable the container to be removed from the vault;

close the vault;

disable access to the transportation utility screen; and lock the electromechanical lock.

20. The apparatus of claim 19 wherein the apparatus is a cash recycler and the input means is part of the electromechanical lock.

* * * * *

UNITED STATES PATENT AND TRADEMARK OFFICE

CERTIFICATE OF CORRECTION

PATENT NO. : 7,940,176 B2
APPLICATION NO. : 12/212442
DATED : May 10, 2011
INVENTOR(S) : Daniel Christopher Bohen et al.

It is certified that error appears in the above-identified patent and that said Letters Patent is hereby corrected as shown below:

On the Title Page, Item (75) under Inventors:
Please delete "Charlotte, CA" and insert -- Charlotte, NC --

Signed and Sealed this
Fourth Day of October, 2011

David J. Kappos

David J. Kappos
*Director of the United States Patent and Trademark Office*